166-66 SR

5/26/87 XR 4,667,738

United States Patent [19]

Codina

[11] Patent Number: 4,667,738

[45] Date of Patent: May 26, 1987

[54] OIL AND GAS PRODUCTION ENHANCEMENT USING ELECTRICAL MEANS

[75] Inventor: George Codina, Hartsdale, N.Y.

[73] Assignee: Ceee Corporation, Stamford, Conn.

[21] Appl. No.: 728,612

[22] Filed: Apr. 29, 1985

Related U.S. Application Data

[63] Continuation of Ser. No. 572,522, Jan. 20, 1984, abandoned.

[51] Int. Cl.[4] ..... E21B 43/26; E21B 49/00

[52] U.S. Cl. ..... 166/248; 166/65.1; 166/66; 166/250; 166/271; 166/308

[58] Field of Search ..... 166/65 R, 66, 177, 248, 166/250, 271, 308; 324/351, 355, 357, 360

[56] References Cited

U.S. PATENT DOCUMENTS

| | | | |
|---|---|---|---|
| 2,156,259 | 5/1939 | Blau | 181/0.5 |
| 2,795,279 | 6/1957 | Sarapuu | 166/248 |
| 2,799,641 | 7/1957 | Bell | 166/248 |
| 3,103,975 | 9/1963 | Hanson | 166/42 |
| 3,106,244 | 10/1963 | Parker | 166/248 |
| 3,169,577 | 2/1965 | Sarapuu | 166/248 |
| 3,208,674 | 9/1965 | Bailey | 241/1 |
| 3,211,220 | 10/1965 | Sarapuu | 166/248 |
| 3,236,304 | 2/1966 | Sarapuu | 166/248 |
| 3,460,766 | 8/1969 | Sarapuu | 241/1 |
| 4,046,194 | 9/1977 | Cloud | 166/248 |
| 4,084,638 | 4/1978 | Whiting | 166/248 |
| 4,135,579 | 1/1979 | Rowland et al. | 166/248 |
| 4,140,179 | 2/1979 | Kasevich et al. | 166/248 |
| 4,313,573 | 2/1982 | Goldberger et al. | 241/1 |
| 4,373,581 | 2/1983 | Toellner | 166/248 X |

*Primary Examiner*—George A. Suchfield

*Attorney, Agent, or Firm*—Bacon & Thomas

[57] ABSTRACT

Disclosed is a method and apparatus for enhancing oil and/or gas production from a subterranean well by using high energy, short duration electrical pulses to fracture underground rock formations containing entrapped oil or gas. The invention obviates the large power requirements of the prior art devices by generating a series of constant pulses having different durations into the rock formation to determine its characteristic impedance. Once the characteristic impedance has been determined, a second pulse having an amplitude and duration matching this characteristic impedance is discharged into the rock formation to alter its dynamic characteristics. A third pulse is then discharged into the rock formation to cause its fracture.

11 Claims, 11 Drawing Figures

Fig. 6
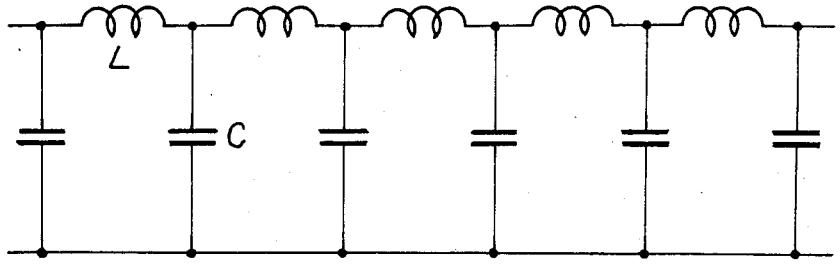
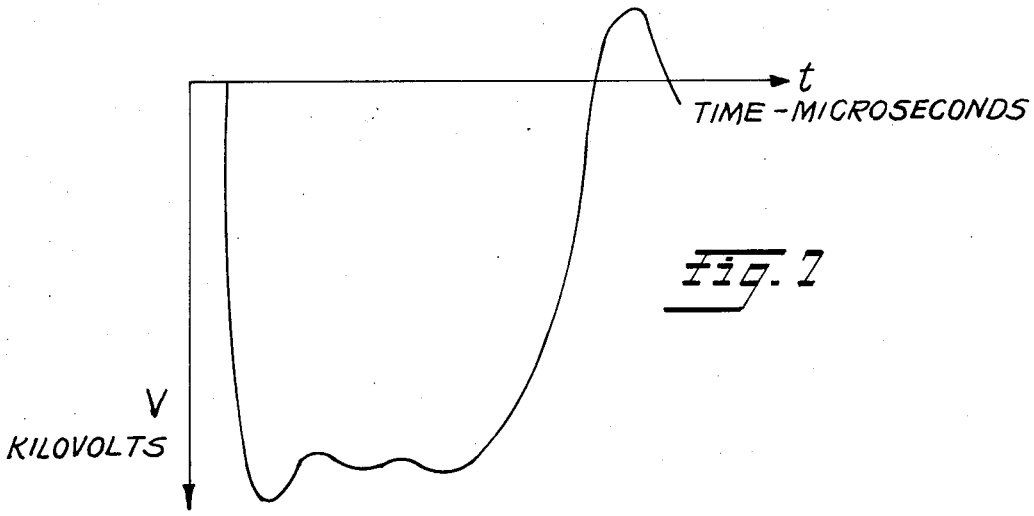
Fig. 7
Fig. 8
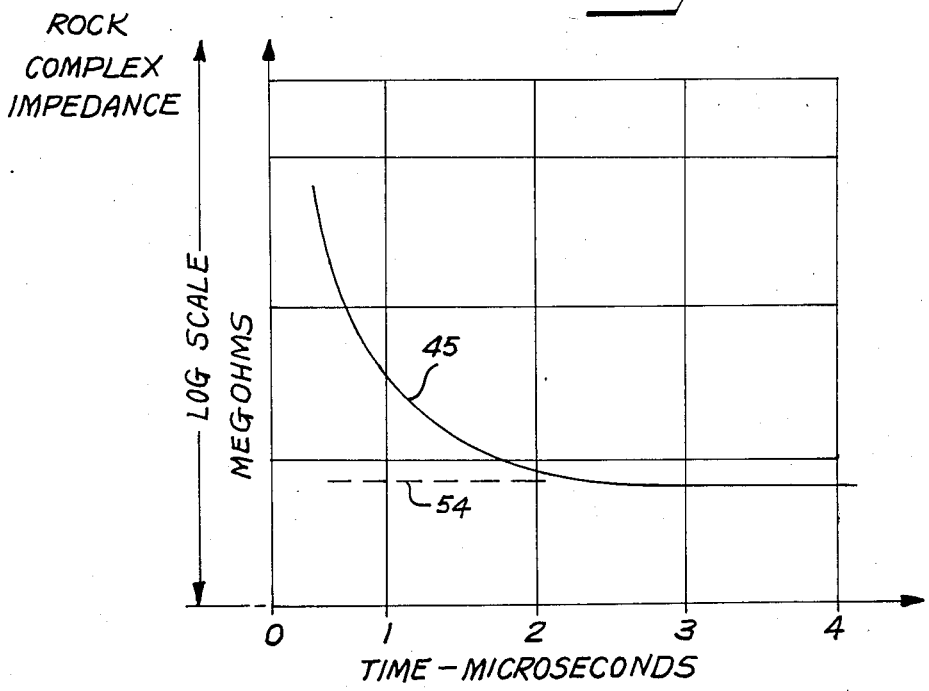

Fig. 9
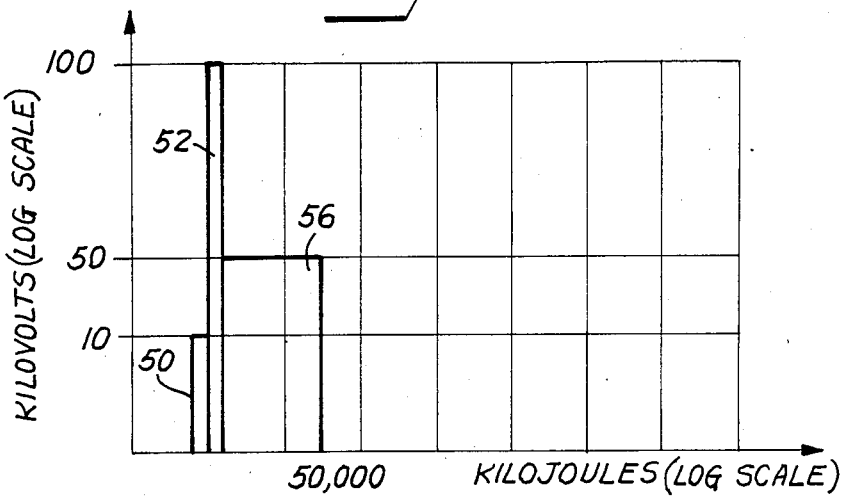
Fig. 10
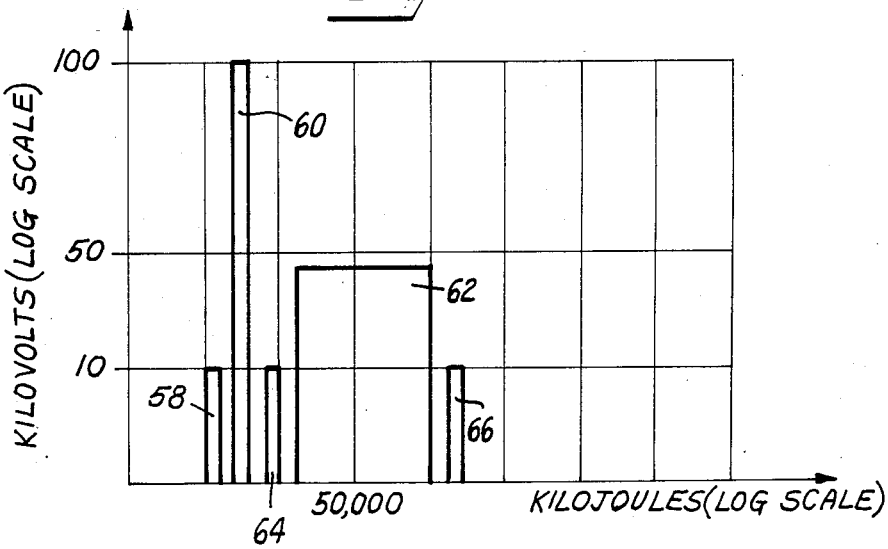
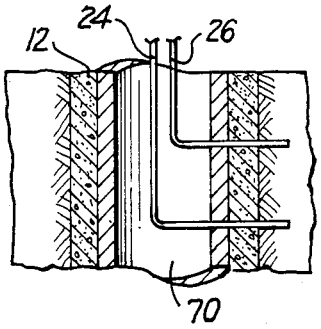
Fig. 11

OIL AND GAS PRODUCTION ENHANCEMENT USING ELECTRICAL MEANS

RELATED APPLICATIONS

This application is a continuation of Ser. No. 572,522, filed on Jan. 20, 1984, and now abandoned. This application is also related to U.S. Ser. No. 730,183, filed on May 3, 1985.

BACKGROUND OF THE INVENTION

1. Field of the Invention

This invention relates to methods and apparatus for enhancing the production of oil and gas wells, specifically those in which rock formations surrounding the well are fractured to release entrapped oil or gas.

2. Brief Description of the Prior Art

The ever increasing requirements in our modern society for fossil fuel products has spurred the development of numerous techniques and apparatus for maximizing the production of subterranean wells. Perhaps the most popular of these techniques is the injection of water or steam into one or more secondary wells surrounding a primary well such that the injected fluid forces the oil or gas towards the primary well.

Although these techniques have proven generally successful, they have not proven adequate to economically remove oil or gas entrapped in a rock formation adjacent a primary well. To remove such entrapped fuel, the prior art techniques have involved many methods of fracturing the rock formation. One such technique involves the injection of an hydraulic fluid either through the main well or an adjacent, secondary well at an increasing pressure until the rock formation reaches its fracturing point. This technique, however, does not provide any control over the amount or direction of fracturing, since, quite obviously, the rock formation will fracture at its weakest point.

Other techniques involve the application of electrical or infra-red energy to the rock formation which causes the fluids entrapped therein to vaporize, thereby increasing the pressure in the formation. When sufficient internal pressure has been generated, the rock formation will fracture. When electrical energy is applied to the rock formation, a plurality of electrodes are disposed in adjacent wells and high energy continuously applied, short duration electrical pulses may be passed between them. These systems generally require a large power input making them uneconomical to use except in those wells where large amounts of unrecovered fuels exist.

SUMMARY OF THE INVENTION

This invention relates to a method and apparatus for enhancing oil and/or gas production from a subterranean well by using high energy, short duration electrical pulses to fracture underground rock formations containing entrapped oil or gas. In the initial embodiment a primary electrode is inserted into a primary well and one or more secondary electrodes are placed in secondary wells arranged about the primary well. The power source for generating the electrical pulses is located at the surface and may comprise a conventional power supply and current regulator having the capability of being automatically set. The instant invention obviates the large power requirements of the prior art devices by generating a series of first constant voltage pulses having different durations into the rock formation to determine the characteristic impedance of a specific rock formation. Each rock formation has a distinct electrical characteristic which varies according to rock type, volume and nature of moisture content, porosity, distance between measuring electrodes, temperature, pressure, etc. Once the characteristic impedance of the formation under pulsed conditions has been determined, a second pulse having an amplitude and duration to match the characteristic impedance is discharged into the rock formation to alter this dynamic characteristic impedance and render the formation more suitable for fracturing.

A third pulse is then discharged into the rock formation, this pulse having the necessary energy to fracture the rock without requiring excessively high input voltage. The second and third pulses may emanate from a capacitor bank which selectively discharges through the electrodes. The system according to the invention not only allows the user to fracture the rock formation with a minimum of input energy, but also allows him to control the direction of fracture, since the rock will fracture between the electrodes. By utilizing a plurality of secondary electrodes arranged in an array around the primary electrode, and by controlling relative depth of the electrodes, various fracturing paths can be formed.

As an alternative, both electrodes can be disposed in a single well, but at different depths. This single well bore stimulation will cause the rock formation to fracture vertically between the electrodes adjacent to the single well.

BRIEF DESCRIPTION OF THE DRAWINGS

FIG. 6 is a schematic diagram of the pulse forming circuit shown in FIG. 3.

FIG. 7 is an example of a pulse shape generated by the pulse forming network shown in FIG. 6.

FIG. 8 is a graph showing the characteristic impedance of a rock formation.

FIG. 9 is a graph showng the pulse sequence generaed by the apparatus according to the invention.

FIG. 10 is a graph showing an alternative pulse sequence in a second embodiment of the invention.

FIG. 11 is a partial sectional side view showing an alternative electrode arrangement according to the invention.

DETAILED DESCRIPTION OF THE PREFERRED EMBODIMENTS

Figure 1:
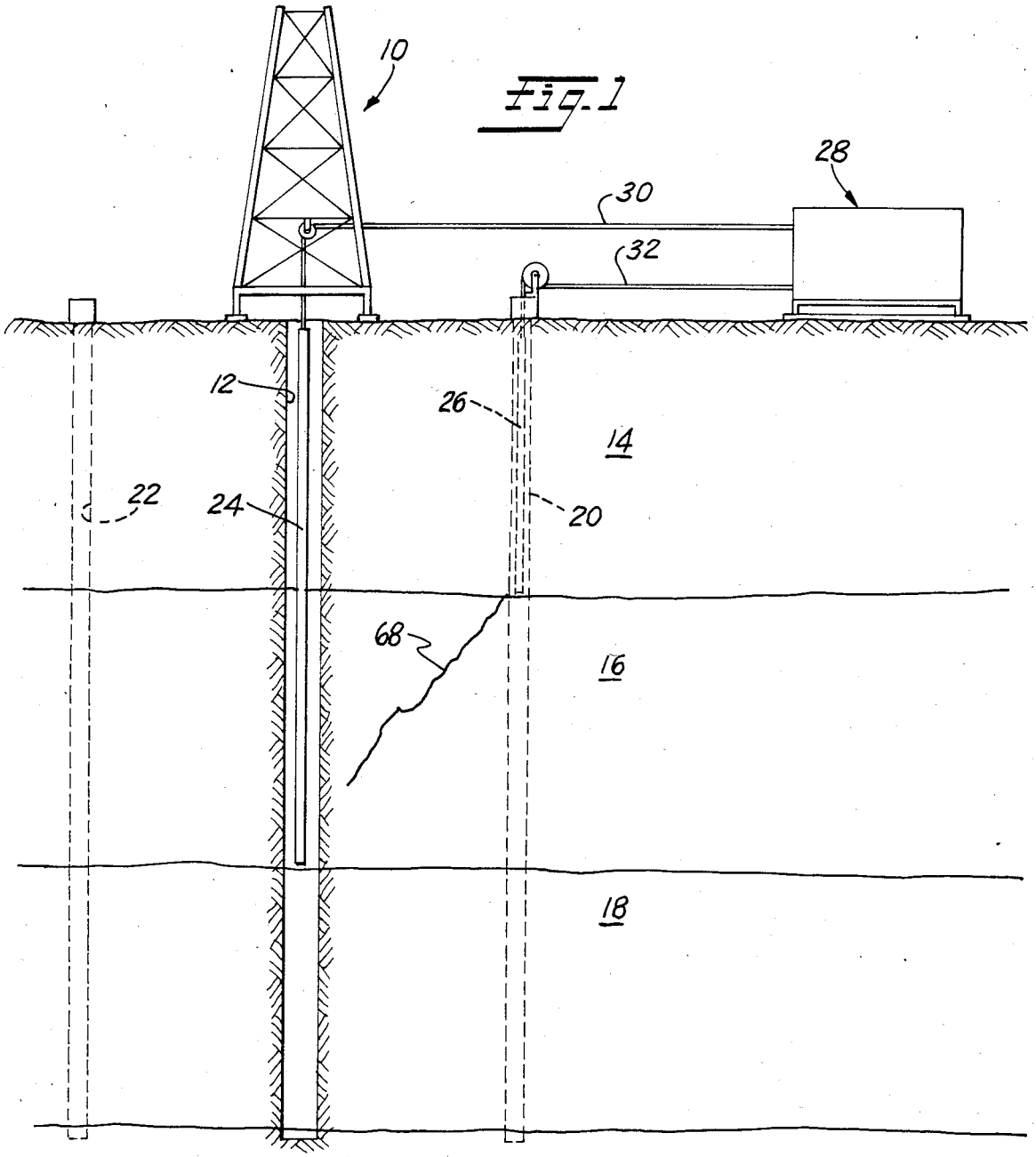
FIG. 1 is a side sectional view of a well system utilizing the apparatus according to the invention.
Figure 2:
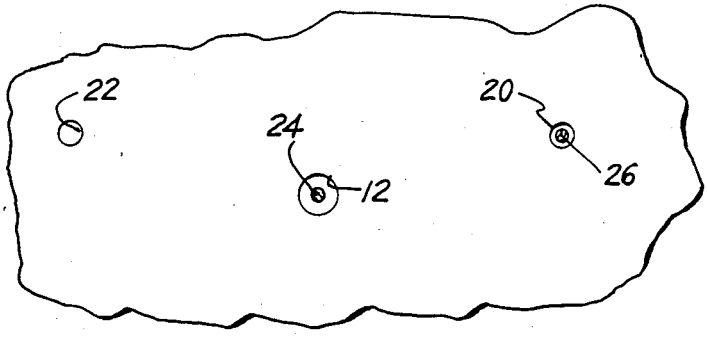
FIG. 2 is a top plan view of the well layout shown in FIG. 1.

The overall system for carrying out the invention is shown in FIGS. 1 and 2 and comprises main oil or gas well 10 having a well bore 12 which extends through varius subterranean strata 14, 16, and 18. Although, quite obviously, these strata may contain various materials depending upon the location in which the main well 10 is drilled, it will be assumed for the purposes of explaining this invention that layer 16 is a rock formation having entrapped oil or gas.

Secondary well 20 is located adjacent to main well 10. Additional secondary wells, indicated at 22, may be drilled to form an array about the main well 10 if desired. However, the invention will be described in terms of using a single secondary well with the understanding that the interaction between the additional secondary wells and the main well follows a similar function.

A primary electrode 24 is passed downwardly through main well bore 12 until its end is located at a desired position in the rock formation 16. Although this position is indicated at being at the lower surface of the rock strata, it is understood that the electrode may be located at any desired location. Similarly, second electrode 26 is inserted into secondary well 20 such that its end is located at the upper surface of the rock formation. Quite obviously, other positions may be utilized depending upon the direction in which it is desired to fracture the rock. If additional secondary wells are utilized, additional secondary electrodes are inserted into each of the wells in similar fashion. The electrode structure per se forms no part of the instant invention and any known electrodes may be utilized.

Figure 3:
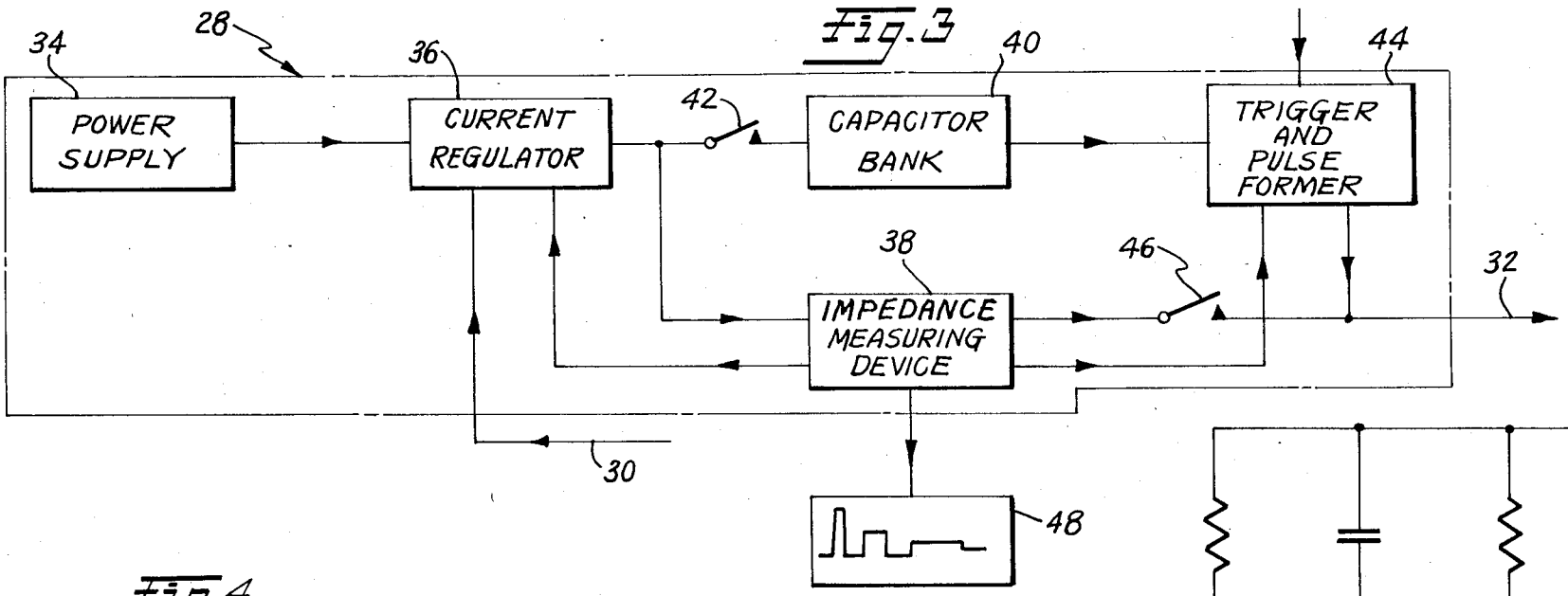
FIG. 3 is a schematic diagram of the control system utilized in the apparatus according to the invention.

The primary and secondary electrodes are connected to a power supply and control system 28, shown schematically in FIG. 1, via connecting cables 30 and 32. As shown in FIG. 3, control system 28 comprises a conventional power supply 34 connected to current regulator 36. Current regulator 36 is of a conventional design having the capability of being automatically set by impedance measuring device 38. Capacitor bank 40 is connected to the current regulator in parallel with impedance measuring device 38 through switch 42. The output of the capacitor bank 40 is connected to trigger switch and pulse forming circuit 44 as is the impedance measuring device 38.

Figure 5:
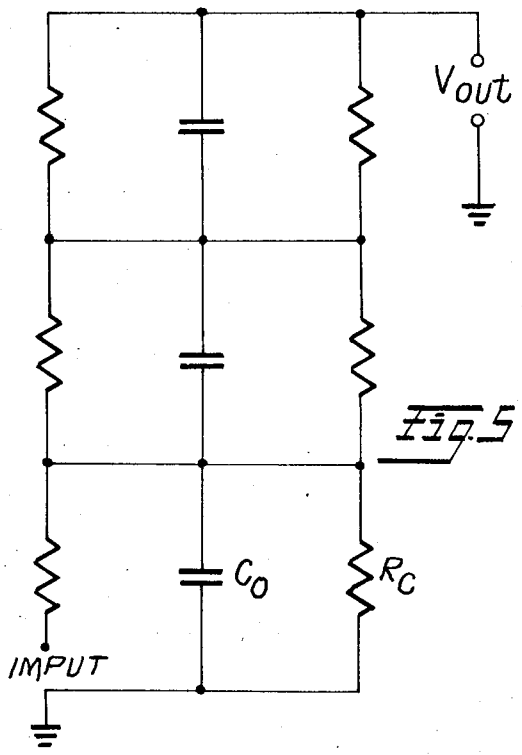
FIGS. 4 and 5 are schematic diagrams of the capacitor bank shown in FIG. 3.
Figure 4:
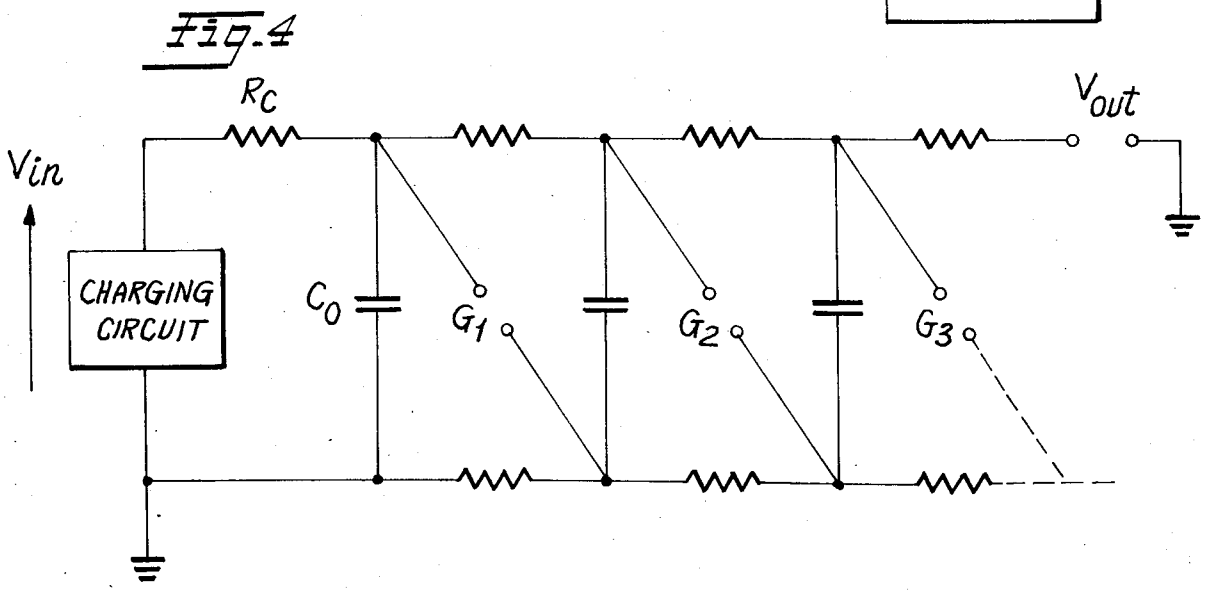

Although various forms of capacitor banks are known and may be utilized with this invention, a typical illustration is shown in FIG. 4 wherein the capacitors are charged in parallel and subsequently switched to series connection for discharge. Conduction occurs when the electric field in each gap exceeds the minimum breakdown voltage. When gap G1 breaks down, twice the input voltage ($V_{in}$) appears at gap G2. Gap G2 then breaks down and three times the input voltage ($V_{in}$) appears at gap G3, and so on. After all gaps have fired, all of the capacitors are connected in series. This is schematically illustrated in FIG. 5.

The pulse forming circuit is schematically shown in FIG. 6 and serves to form the output of the capacitor bank into the desired shaped pulse to maximize fracturing of the rock formation. The pulse curve shown in FIG. 7 is a typical curve for a five-section forming network.

The solid line 45 on the graph shown in FIG. 8 is representative of a large impedance change of a given rock formation under pulsed conditions. As is readily seen, a pulse of a short duration is required to have an exorbitantly large energy input. If the pulse is lengthened, the peak energy is lowered, but since it is maintained for a longer period of time, the total energy required is still excessive. To obviate this, the invention proposes to subject the rock formation to a series of electrical pulses as noted in FIG. 9. First pulse series 50 is passed into the rock formation to determine the characteristic impedance of this formation from the known voltage and measured current under pulsed conditions (i.e., the solid line curve in FIG. 8). Based upon that information, a second pulse 52 having an extremely high voltage level and an extremely short duration (less than a microsecond) is then discharged into the rock formation. This pulse establishes an EMF around the electrodes and lowers the characteristic impedance of the rock formation. The lowered impedance is shown as the dashed line 54 in FIG. 8.

Following pulse 52, a third pulse 56 having a lower peak voltage level than pulse 52, but a higher energy level (due to the longer pulse duration) is discharged into the rock formation to cause its fracture. Since the characteristic impedance curve of the formation has been lowered by pulse 52, the rock can be fractured by only one pulse thereby resulting in less expenditure of energy than the prior art systems.

The characteristic impedance of the specific rock formation will be viewed on CRT scope 48 during the first pulse series 50. This information along with the known voltage fed into trigger and pulse former 44 to automatically form the optimal pulse shape. After pulse former 44 has been set, switch 42 is closed and capacitor bank 40 is charged as previously discussed. Prior to the first discharge, switches 42 and 46 are opened.

After the third pulse 56 has been discharged, a pulse corresponding to the first pulse series 50 may be again generated and viewed on scope 48 to determine whether the impedance of the rock formation has been changed which would indicate that a fracture has occurred. If not, additional discharges can be made corresponding to the new characteristic impedance curve. The process can be repeated as often as necessary until sufficient fracturing has occurred.

An alternative pulse form is shown in FIG. 10. In this embodiment, pulse series 58 and pulses 60 and 62 correspond to pulse series 50 and pulses 52 and 56, respectively, and serve the functions previously discussed. Additional series of pulses (schematically illustrated at 64 and 66); are generated before and after pulse 62 in order to determine the effects of impedance changing pulse 60 and the fracturing effect of pulse 62.

The instant invention not only achieves the fracturing of the rock formation with a minimal expenditure of energy, but also enables the controlling of the directon of the fracturing. By altering the position of electrodes 24 and 26, rock fracture path 68 can be altered from that shown in FIG. 1. Also, by using a plurality of secondary wells arranged in an array around the main well, the radial location of the fracture can also be controlled.

FIG. 11 shows another embodiment of the instant invention wherein primary and secondary electrodes 24 and 26 are disposed in a single well bore 12. The electrodes extend downwardly through plate casing 70 and extend laterally through the wall of the casing into the rock formation. The application of energy pulses as noted above will cause the rock to fracture between the electrodes.

The foregoing description is provided for illustrative purposes only and should not be construed as in any way limiting this invention, the scope of which is determined solely by the appendant claims.

I claim:

1. A method of fracturing a rock formation to enhance the production of an adjacent oil or gas well comprising the steps of:

(a) locating at least a pair of electrodes in the rock formation such that at least one of the pair of electrodes is adjacent the well;

(b) determining the characteristic impedance of the rock formation;

(c) applying a high amplitude, short duration pulse of electrical energy to the electrodes to lower the characteristic impedance of the rock formation; and, (d) applying a fracturing pulse of electrical energy to the electrodes to cause the rock formation to fracture, thereby releasing entrapped oil or gas.

2. The method of fracturing a rock formation according to claim 1 wherein the characteristic impedance of the rock formation is determined by the steps of: applying to the electrodes a series of constant voltage electrical pulses having different durations; and selecting the maximum discharge pulse shape.

3. The method of fracturing a rock formation according to claim 2 wherein the high amplitude electrical pulse is applied to the electrodes for a duration of 1 microsecond or less.

4. The method of fracturing a rock formation according to claim 3 comprising the further step of: applying to the electrode a second series of constant voltage electrical pulses having different durations after the application of the high amplitude, short duration pulse to determine the amount of change in the characteristic impedance of the rock formation.

5. The method of fracturing a rock formation according to claim 4 comprising the further step of: applying to the electrodes a third series of constant voltage electrical pulses having different durations after the application of the fracturing pulse to determine the amount of fracturing of the rock formation.

6. The method of fracturing a rock formation according to claim 1 comprising the further steps of:

(a) placing one of the pair of electrodes in a first well; and, (b) placing the other of the pair of electrodes in a second well located a predetermined distance from the first well.

7. The method of fracturing a rock formation according to claim 6 comprising the further step of placing the electrodes at substantially the same depth in the wells.

8. The method of fracturing a rock formation according to claim 6 comprising the further step of placing the electrodes at different depths in the wells.

9. The method of fracturing a rock formation according to claim 1 comprising the further steps of:

(a) placing one of the electrodes in a first well;

(b) drilling a plurality of second wells in an array around the first well; and (c) placing an electrode in each of the plurality of second wells.

10. The method of fracturing a rock formation according to claim 9 wherein all of the electrodes are disposed at substantially the same depth in the wells.

11. The method of fracturing a rock formation according to claim 9 wherein the electrode in the first well is disposed at a depth different from those in the second wells.

* * * * *